United States Patent [19]

Lynn-Jones

[11] 4,271,650

[45] Jun. 9, 1981

[54] EXPANSION JOINT COVER

[75] Inventor: David M. Lynn-Jones, Muncy, Pa.

[73] Assignee: Construction Specialties, Inc., Cranford, N.J.

[21] Appl. No.: 962,933

[22] Filed: Nov. 22, 1978

[51] Int. Cl.[3] ..... E01C 11/02; E04F 15/14

[52] U.S. Cl. ..... 52/395; 52/403; 404/69

[58] Field of Search ..... 52/395, 396, 403; 14/16.5; 404/67–69; 49/475

[56] References Cited

U.S. PATENT DOCUMENTS

| | | | |
|---|---|---|---|
| 3,183,626 | 5/1965 | Schmitt | 52/396 X |
| 3,336,707 | 8/1967 | Horgan | 52/395 X |
| 3,339,329 | 9/1967 | Berg | 52/395 |
| 3,371,456 | 3/1968 | Balzer et al. | 52/396 X |
| 3,390,501 | 7/1968 | Driggers | 52/396 |
| 3,750,359 | 8/1973 | Balzer et al. | 52/396 X |
| 3,797,188 | 3/1974 | Mansfeld | 52/396 |
| 3,880,540 | 4/1975 | Rizza et al. | 404/69 |
| 4,007,994 | 2/1977 | Brown | 52/396 X |
| 4,063,840 | 12/1977 | Fordyce et al. | 404/69 |
| 4,120,066 | 10/1978 | Leroux | 14/16.5 |

FOREIGN PATENT DOCUMENTS

| | | | |
|---|---|---|---|
| 1271742 | 7/1968 | Fed. Rep. of Germany | 14/16.5 |

*Primary Examiner*—J. Karl Bell

*Attorney, Agent, or Firm*—Brumbaugh, Graves, Donohue & Raymond

[57] ABSTRACT

An expansion joint cover comprises at least one elongated frame assembly which includes a base member having a bridge-supporting rib adjacent the gap and a cover-supporting flange spaced laterally outwardly from the rib, the cover-supporting flange having an upwardly open groove and an abutment located laterally outwardly from the groove, relative to the expansion gap. A cover member having, in cross-section, a web portion, a bridge-supported flange extending down from the underside of the web portion adjacent to the gap and generally vertically above the rib of the base member and a retainer rib extending down from the underside of the web portion, is fastened to the base member of the frame assembly by longitudinally spaced-apart, generally U-shaped spring clips received on the retainer rib of the cover member and in the groove of the base member. The clips hold the cover member and base member together, and a portion of the cover member outwardly from the clips engages the abutment of the base member and prevents tipping or rocking of the cover plate about the retainer rib in a direction tending to unseat the bridge-supported rib from a supported position on the bridge. A bridge plate spans the expansion gap, and a resilient filler strip is supported by the bridge and retained on at least one of the frames by reception of an edge portion thereof with an inwardly open cavity on the frame.

9 Claims, 9 Drawing Figures

EXPANSION JOINT COVER

BACKGROUND OF THE INVENTION

This invention relates to expansion joint covers and, in particular, to expansion joint covers intended generally for interior use in job conditions requiring load-supporting capability, reasonably good sealing against moisture and the ability to allow relative vertical movements and relative horizontal movements both longitudinally and transversely of the expansion joint. A cover embodying the present invention is quickly and easily installed, thus minimizing on-site installation costs, and provides an upper surface across the expansion gap throughout the range of movements that is substantially contiguous to the surfaces of the structures on either side of the gap.

A rather large number of expansion joint designs are in commercial use, and it is, at best, difficult to ascribe any special advantages or disadvantages to known types of expansion joint covers as a class of product. Each design will undoubtedly have certain advantages for certain job conditions, and will probably have some disadvantages in all applications.

The general requirements for an effective expansion joint cover system are: that it be capable of accommodating relative vertical movement and relative horizontal movements, both longitudinally and transversely of the expansion gap, of the structures on either side of the gap; that the time and effort involved in installing the cover be minimized; that it provide an effective seal against passage of air and liquid; and that it have load-supporting capability. It is also desirable that the upper surface of the cover be contiguous entirely across the cover assembly so that the cover will be flush with the floor on both sides of the gap, in the case of floor-to-floor covers, and the floor section on one side of the gap, in the case of floor-to-wall covers. In other words it is preferable that there be no component lying substantially above or below the plane of the floor and that contiguity between the upper surface of the cover assembly and the floor surface or surfaces adjacent to it remain through the range of the movements of the gap except, of course, to the extent that the structure on one side of the gap moves vertically relative to the structure on the other side of the gap. In the event of relative vertical movement, the cover should provide a smooth transition from one floor level to the other. An expansion joint cover embodying the present invention meets the foregoing requirements very effectively.

SUMMARY OF THE INVENTION

There is provided, in accordance with the present invention, an expansion joint cover comprising at least one elongated frame assembly composed of a base member and a cover member. In a floor-to-floor cover the same frame assembly is used on both sides of the gap, while in a floor-to-wall cover the aforementioned frame assembly is used only on the floor side of the gap, and a suitable support is secured to the wall. The base member of the frame assembly includes, in cross section, a bridge-supporting rib adjacent the gap and a cover-supporting flange spaced laterally outwardly from the rib. The cover-supporting flange has an upwardly open groove and an abutment located laterally outwardly from the groove, relative to the gap. The cover member has, in cross-section, a web portion, a bridge-supported flange extending down from the underside of the web portion adjacent the gap at a position generally vertically above the bridge-supporting rib of the base member and a retainer rib that extends down from the web portion and is received in the groove of the base member.

One important aspect of the present invention is the manner in which the cover member and base member of the frame assembly are joined to each other, namely, by a multiplicity of longitudinally spaced-apart, generally U-shaped spring clips which snap onto and are firmly retained on the retainer rib of the cover member and are received in and firmly grip the groove of the base member. This type of spring clip is known per se, but it provides joinder only against separation of the members and very little resistance to pivoting of two members that it connects. Accordingly, the frame assembly, according to the invention, includes an abutment located laterally outwardly from the retaining groove of the base member and engaged by a portion adjacent the edge of the cover plate such that the cover plate is prevented from pivoting or tilting in a direction tending to unseat the bridge-supported rib of the cover plate from supported position on the bridge.

The aforementioned term "bridge" refers to a bridge plate that extends across and lengthwise of the expansion gap. In the case of a floor-to-floor cover, the bridge plate is supported on either side of the gap by the bridge-supporting rib of each of the frame assemblies; in the case of a floor-to-wall cover, the bridge plate is supported on the wall side of the gap by some element of the wall frame member. The bridge plate is located some distance below the floor level and supports a resiliently compressible sealing element. The construction of the sealing element and its relationship to the cover plate and to the frame members represents another important aspect of the present invention. More particularly, the sealing element consists in cross section of a series of vertical and horizontal walls that define a multiplicity of side-by-side cells. The configuration of the walls is such that the upper surface of the sealing element remains essentially contiguous to the upper surfaces of the cover plates of the frame assembly throughout the range of movement of the joint, particularly movement in the transverse direction. An important characteristic of the sealing element is that it does not tend to hump up appreciably when the expansion joint closes. The construction and mode of operation of the sealing element is described in detail in connection with the embodiments illustrated in the accompanying drawings.

Another aspect of the present invention involves the manner in which the sealing element is retained in place in the cover assembly. The lateral edges of the sealing elements are received in inwardly open cavities defined between portions of the bridge plate and an over-hanging edge portion or flange of the cover plate. Unlike most sealing elements used in expansion joint covers, there are no beads or other retaining elements along the edges which are gripped or captured in the frame members. On the contrary the edge portions of the sealing element are relatively free to move within the edge retaining cavities of the frame member when the expansion joint opens to a relatively wide separation and also to accommodate horizontal relative movement in the lengthwise direction.

The sealing element is held down and in fixed position relative to the bridge plate by a retaining rib on the bridge plate that is received between and grips the walls of a slot extending lengthwise along the underside of the sealing element. Except when the joint opens relatively widely, the outer edges of the sealing element are engaged by the bridge-supported rib of the cover plate, and the balancing of compression forces in the sealing element keeps the sealing element and the bridge centered between the frame assemblies. When the joint opens relatively widely, the cavities move away from the edges of the sealing element, but not enough to release the edges from retention part way within the cavities. The bridge plate has flanges along either edge which keep it and the sealing element generally centered between the frame members in the widely open position. The relative movement between the cavities and the edges of the sealing element in open positions of the gap makes it possible to limit the degree of extension and compression of the sealing element, relative to the degree of opening and closing of the gap. This in turn contributes to the maintenance of an upper surface in the sealing element which is generally contiguous to the surfaces of the floor on either side of the gap through the entire range of movement while permitting a relatively wide range of expansion and contraction of the gap.

DESCRIPTION OF THE EMBODIMENTS

Figure 1:
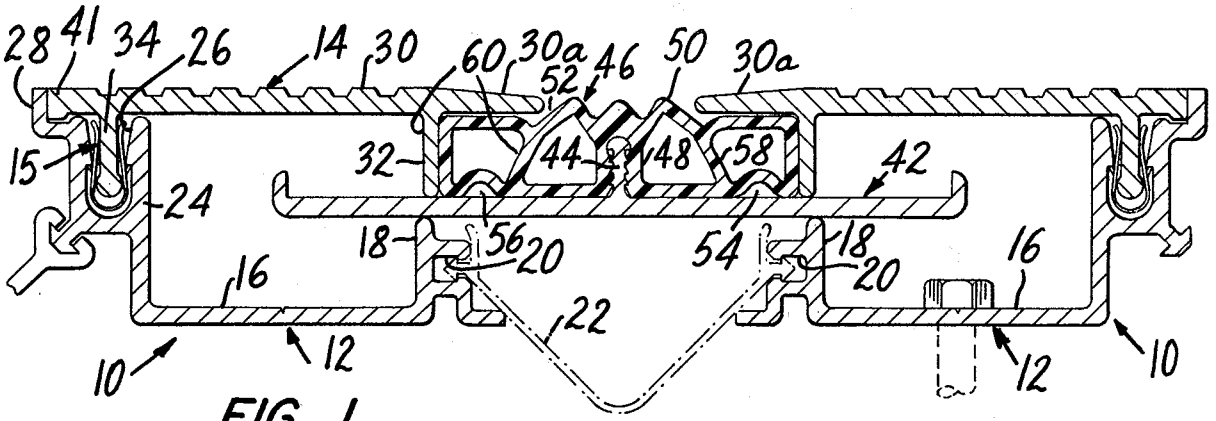
FIG. 1 is an end cross-sectional view of an embodiment of the expansion joint cover, according to the present invention.
Figure 2:
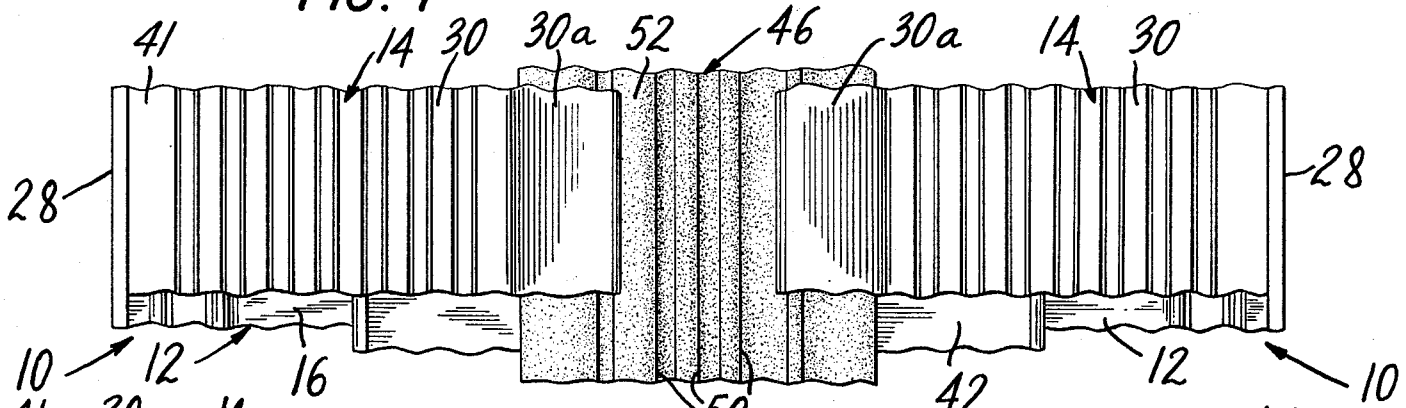
FIG. 2 is a top view of a typical section of the cover of FIG. 1.

The expansion joint cover shown in FIGS. 1 to 5 is a floor-to-floor cover and comprises two frame assemblies, one on either side of the expansion gap. The two frame assemblies are identical to each other, but one is turned end for end relative to the other in the installation. Each frame assembly 10 comprises a base member 12 and a cover plate 14 joined to each other by a series of spring clips 15, as described in more detail below. The base member is very generally U-shaped in cross section, is preferably made by extrusion of aluminum and is, accordingly, of uniform cross section throughout its length. It includes a lower wall 16 having along its edge adjacent the gap an upwardly extending bridge supporting rib or flange 18. The rib or flange 18 has further ribs which extend inwardly towards the gap and define a capturing recess 20 for reception and securement of one edge of an optional rubber or plastic water stop 22.

A cover-supporting flange 24 extends up from the outer edge of the lower wall 16 of the base member and has a relatively large and deep groove 26 which opens upwardly. The walls along the upper portion of the groove taper upwardly and outwardly to facilitate reception of the clips 15, and there are shoulders about half-way down each wall of the groove for capturing the tangs of the clips, as described below. The outer extremity of the flange 24 includes a rib 28 which serves as an abutment against which the outer edge of the cover plate 14 bears, such bearing or engagement between the abutment and the cover plate being important to retention of the cover plate on the base member and being described in more detail below.

The cover plate 14 of the expansion joint cover of FIGS. 1 to 5 is also of substantially uniform cross section along its length and is preferably made by extrusion of aluminum. It consists of a relatively wide, thin web portion 30, a bridge-supported flange (or rib) 32 extending down from the underside of the web portion laterally outwardly from the edge of the web portion at the gap and a retaining flange 34 extending downwardly adjacent the edge remote from the gap. The bridge-supported flange is aligned substantially vertically over the bridge-supporting flange 18 of the base member 12. The flange 34 is received in the slot or groove 26 in the cover-supporting flange 24 of the base member 12.

Figure 9:
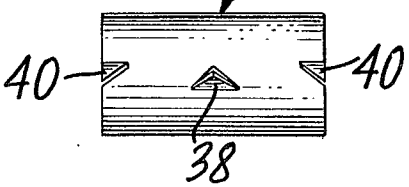
FIG. 9 is a front elevational view of a spring clip used to connect the parts of the frame member.
Figure 3:
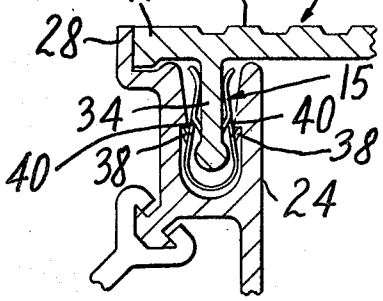
FIG. 3 is a fragmentary end cross-sectional view on a larger scale than in FIG. 1 showing how the clip joins the base member and cover plate of a frame member.

The way in which the cover plate is secured to the base member of each frame is best shown in FIG. 3. The small U-shaped spring clips 15, which are known per se but are applied in a unique environment in the present invention, are located at a roughly uniform spacing along the length of the cover member, say twelve inches apart. Each clip (see FIGS. 3 and 9) is generally U-shaped in cross section and is about ½ inch in length. The upper ends of the legs of the "U" are flared outwardly to facilitate pushing the clip onto the flange 34, and the legs, when the clip is relaxed, are normally somewhat closer to each other than as shown in FIG. 3 so that they grip the flange when installed. Small lower tangs 38 extend outwardly and upwardly from the center of the lower part of each leg, and two tangs 40 extend generally downwardly and inwardly from each edge of each of the legs. The lower tangs 38 engage the downwardly facing shoulders in the walls of the groove 26 of the base member, and the upper tangs 40 engage the walls of the flange 34 of the cover plate. The enlarged lower end of the flange 34 normally plays no role in the anchoring of the cover plate in place but is provided to ensure that if the cover plate should for any reason lift and tend to dislocate the flange from the groove, the upper inwardly directed tangs 40 will engage the edges of the enlargement and almost certainly prevent the cover plate from being totally dislodged. The tangs 38 and 40 are sharply pointed and tend to dig into the pieces they engage; the chance of the cover plate loosening or being dislodged is virtually nil in normal usage of the expansion joint cover.

It should be apparent from the drawings that the spring clips, though they provide good retention against vertical separation or relative movement between the base member and cover plate, do not themselves provide much resistance to pivoting of the cover plate about an axis located generally in the area of the tangs. Accordingly, the invention provides, as a way of holding the cover plate down in position with the bridge-supported flange resting on the bridge, firm engagement between the abutment flange 28 on the base member 12 and the outer edge 41 of the cover member 14 to keep the cover plate from tipping or rocking in a direction tending to unseat the cover plate.

The gap between the frame members 10 of the expansion joint cover is bridged by a bridge plate 42, preferably an aluminum extrusion of uniform cross-section along its length, which has upturned flanges along each edge and a central upright rib 44 having downwardly facing gripping teeth along each face. The bridge plate 42 is supported by the bridge-supporting flanges 18 of the base members 12 and, in turn supports the bridge-supported flanges 32 of the cover plates 14.

The bridge plate 42 supports a sealing element or gasket 46 which is preferably made by extrusion from an elastomeric material, such as neoprene or polyvinylchloride. It consists of a series of generally horizontal and generally vertical walls defining side-by-side longitudinal cells. The central vertical wall 48 has a slot extending in from the lower edge which receives the central rib 44 of the bridge plate. The teeth on the rib 44 dig into the sides of the slot and hold the center part of the gasket down on the bridge plate. The upper edge of the center wall 48 is of inverted V-shape in cross-section and the uppermost part lies generally flush with the upper surfaces of the cover plates of the frames. The two center cells (the ones on either side of the common center vertical wall 48) have inverted V-shaped upper walls 50 and 52, the uppermost extremities of which also lie generally in the plane of the upper surfaces of the cover members 14. The "V" shapes of the upper walls 50 and 52 induce folding of those walls upon compression of the gasket (see FIG. 4) without excessive bulging of the upper extremities of the gasket above the plane of the surfaces of the cover plates. Thus, when the expansion gap closes, the upper surface of the gasket continues to lie substantially contiguous to the surfaces of the cover members.

As originally formed (see FIG. 5), the vertical walls of the gasket lie substantially vertically. The lower walls 54 and 56 of the outermost cells are downwardly concavely curved. Under the nominal design opening of the gap, the gasket is held under moderate compression, which produces slight deformation of the lower walls 54 and 56 of the outermost cells and distortion of the vertical dividing walls 58 and 60 from vertical to inwardly inclined orientations.

There are no beads or other retaining elements on the gasket. Instead, the edges of the gasket received within concavities defined by the outer edges of the base plate 42, the bridge-supported flanges 32 of the cover plates 14 and overhanging edges 30*a* of the cover plates. This means that no special steps are required to install the gasket.

Figure 4:
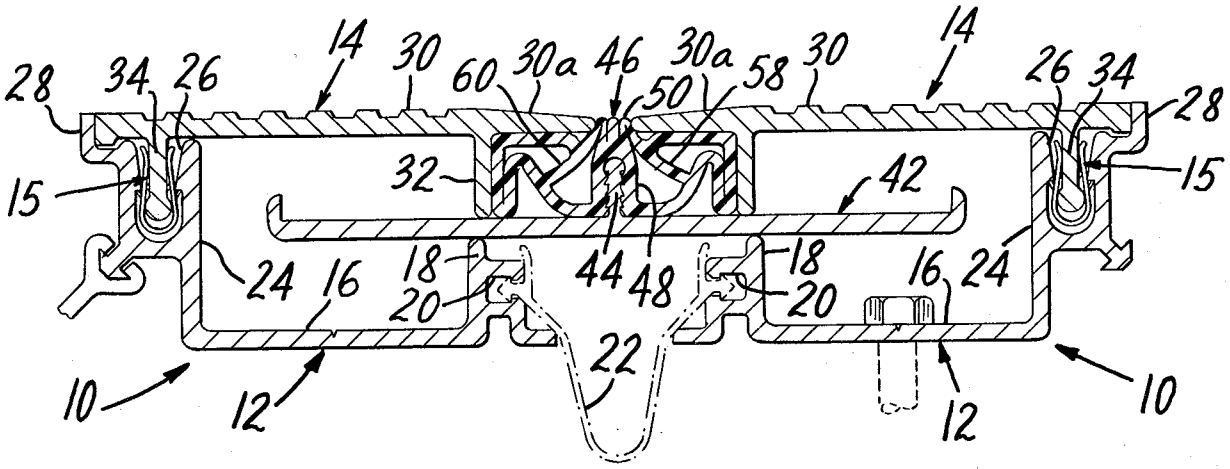
FIG. 4 is an end cross-sectional view of the cover of FIG. 1 in the closed position.
Figure 5:
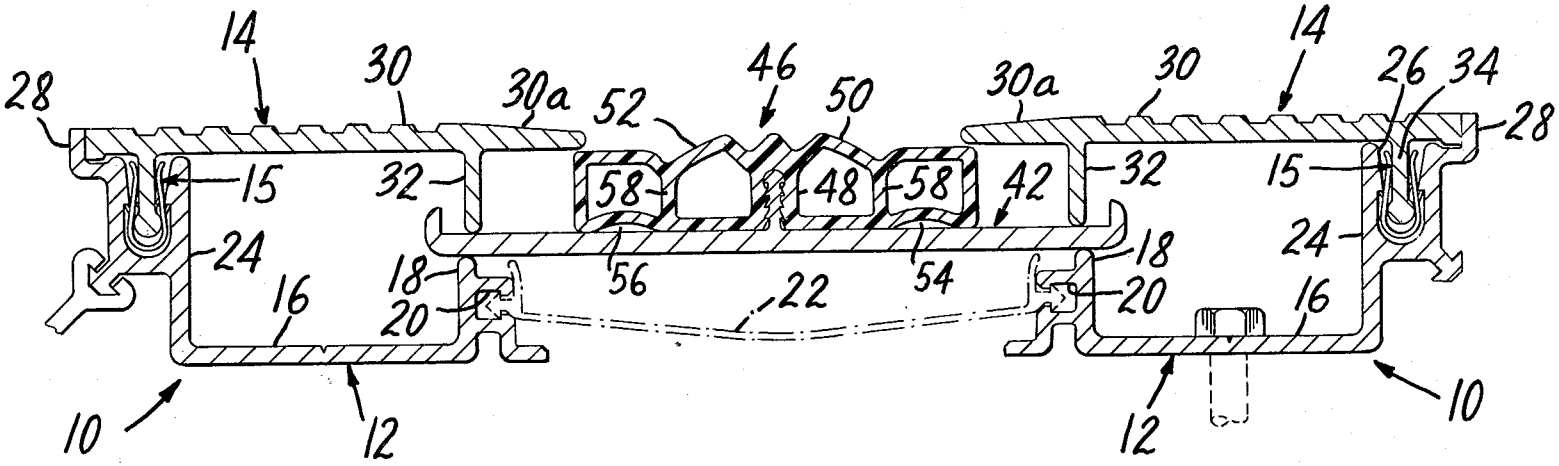
FIG. 5 is an end cross-sectional view of the cover of FIG. 1 in fully opened position.

The sealing gasket 46 achieves the configurations illustrated in FIGS. 1, 4 and 5 upon openings and closings of the expansion gap. In the nominal design extent of gap opening, as shown in FIG. 1, the gasket is slightly compressed and is slightly distorted from its uncompressed shape. In the full opening position, which is rarely attained in practice, the gasket relaxes and achieves its shape as initially formed, while the cavities which receive the edge cells of the gasket move away from the edges of the gasket but leave small portions of the gasket retained under the overhang 30*a* of each cover member 14. In the fully closed position of the gap (FIG. 4), the gasket is compressed with the upper V-shaped walls 50 and 52 folded and all of the cells compressed predominantly by distortion of the lower generally horizontal walls of the gasket. The upper horizontal and outer vertical walls of the two outer cells remain essentially undistorted and in firm, sealing engagement with the overhanging 30*a* and the flange 32 of each cover plate 14.

Figure 6:
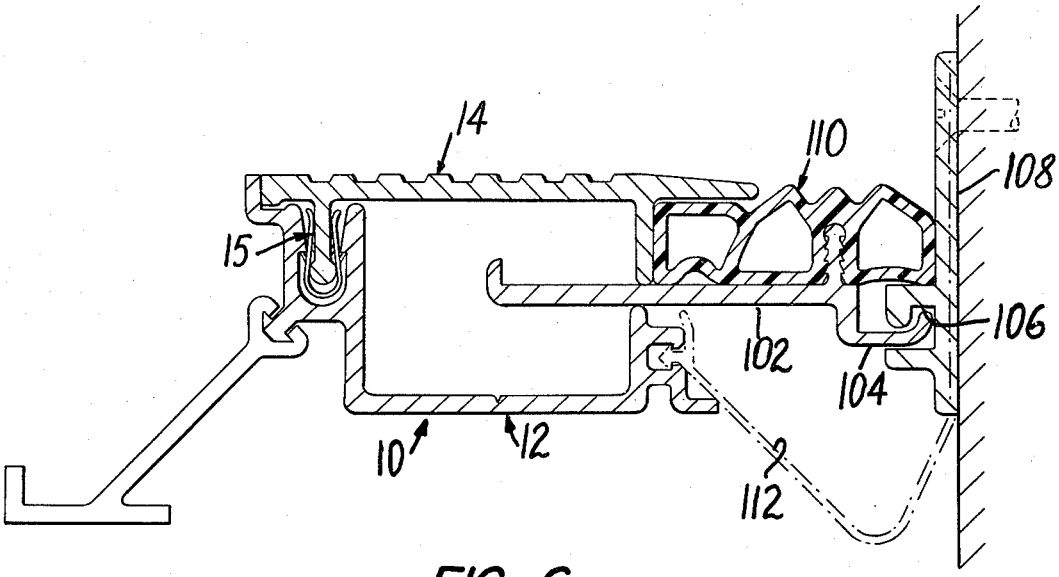
FIG. 6 is an end cross-sectional view of a floor-to-wall cover embodying the invention.

The floor-to-wall expansion joint cover shown in FIG. 6 comprises a frame assembly 10 that is identical in all respects to the frame assembly 10 of the embodiment of FIGS. 1 through 5. The bridge 102 has a flange or hook 104 which is received and locked in place in a capturing slot 106 on a wall frame member 108. The wall frame member 108 consists simply of a plate having flanges which define the retaining slot 106 and is fastened by screws or otherwise suitably secured to the wall. The gasket 110 of the embodiment of FIG. 6 is the same gasket used in the embodiment of FIGS. 1 through 5 but modified by merely cutting one of the outside cells off. This means that it is unnecessary to provide tooling for, or to stock material for, a different gasket for use in the floor-to-wall joint; instead the same gasket can be used for both floor-to-floor and the floor-to-wall expansion joint covers. In a similar manner, the same optional sealing gutter 112 can be used by merely cutting off the retaining element along one edge and then installing on the edge behind the wall frame 108 while hooking the other edge to the floor frame 10.

Figure 7:
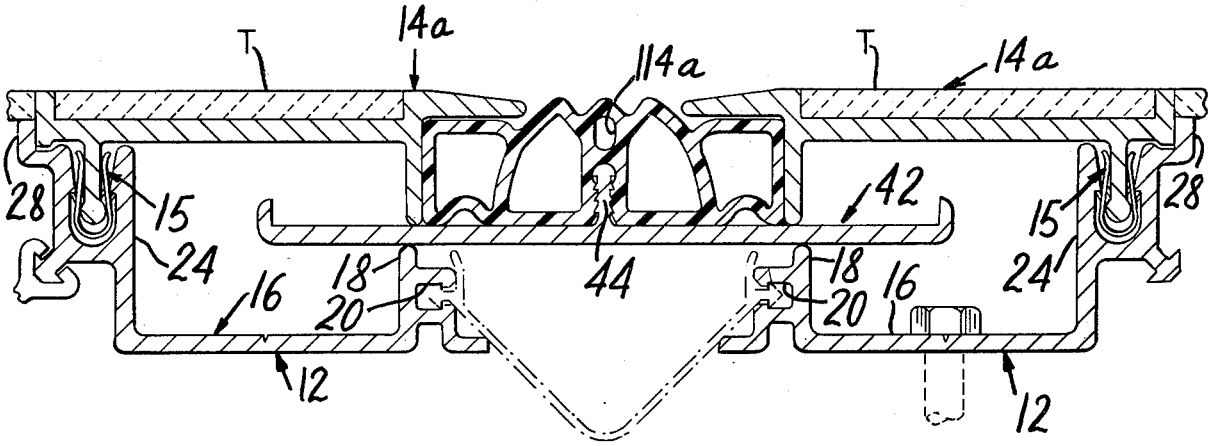
FIG. 7 is an end cross-sectional view of a modified floor-to-floor expansion joint cover.
Figure 8:
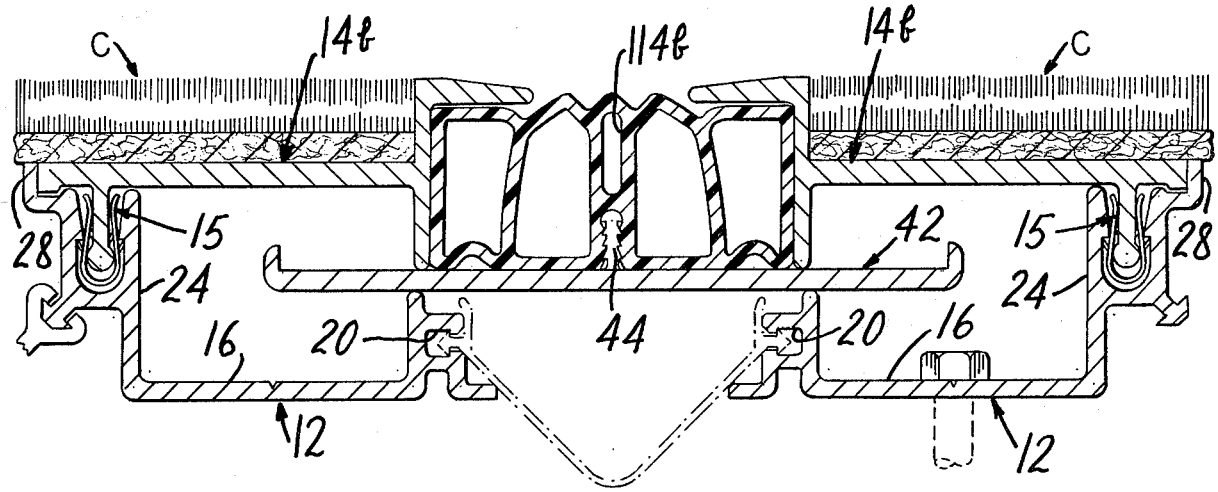
FIG. 8 is an end cross-sectional view of another embodiment of a floor-to-floor expansion joint cover.

FIGS. 7 and 8 show modifications in the design of the frame members and the gasket to adapt the basic principles of the invention to installations which use floor tile T for the finished floor (FIG. 7) or carpet C for the finished floor (FIG. 8). In both cases the base member 12 of the frame assemblies is identical to base members of the frame of the embodiment of FIGS. 1 through 5. The cover plates 14*a* and 14*b* are modified to provide recesses for pieces of title T (FIG. 7) or to allow the carpet C to be brought up to the overhanging portions of the cover plates (FIG. 8). The gaskets 46*a* and 46*b* in the embodiments of FIGS. 7 and 8 are substantially identical to the ones shown in FIGS. 1 through 5 except that they are of increased height and the center wall has a longitudinally continuous hole 114*a* or 114*b* to facilitate folding and collapse of the upper center part. It is readily apparent from the drawings that the basic structure and mode of operation of the embodiments of FIGS. 7 and 8 are in all material respects, identical in substance to the structure and mode of operation of the embodiments of FIGS. 1 to 5.

I claim:

1. An expansion joint cover for closing an expansion gap between sections of a structure comprising at least one elongated frame assembly including (1) a base member having in cross section a bridge-supporting rib adjacent the gap and a cover-supporting flange spaced laterally outwardly from the rib, the cover-supporting flange having an upwardly open groove and an abutment located laterally outwardly from the groove, relative to the expansion gap, the frame assembly further including (2) a cover member having in cross-section a web portion, a bridge-supported flange extending down from the underside of the web portion adjacent the expansion gap generally vertically above the bridge-supporting rib of the base member and a retainer rib extending down from the underside of the web portion and received in the groove of the base member, and the frame assembly further including (3) a multiplicity of longitudinally spaced-apart generally U-shaped spring clips received on the retainer rib and received in the groove of the base member and securing the cover plate to the base member against relative vertical movement with part of the web portion of the cover engaging the abutment of the base member and preventing tipping of the cover plate about the retainer rib in a direction tending to unseat the bridge-supported flange from supported position on the bridge; a bridge plate spanning the gap, supported on the bridge-supporting rib of the base member and supporting the bridge-supported flange of the cover member, and an elongated resilient filler strip supported by the bridge and spanning the expansion gap transversely.

2. An expansion joint cover according to claim 1 wherein each spring clip includes interconnected leg portions straddling the retainer rib of the cover plate, each leg having at least one first tang projecting obliquely outwardly and upwardly and gripping a wall of the groove and at least one second tang projecting obliquely inwardly and downwardly and gripping a wall of the retainer rib.

3. An expansion joint cover according to claim 2 wherein the groove is undercut to define downwardly facing shoulders for capturing the second tangs of the clips.

4. An expansion joint cover according to claim 2 wherein the retainer rib has an enlarged bead along its free edge defining upwardly facing shoulders for capture by the first tangs.

5. An expansion joint cover according to claim 1 wherein the abutment on the retainer flange includes a rib that extends above the top of the groove and engages the outer edge of the web portion of the cover plates.

6. An expansion joint cover according to claim 1 wherein the cover member further includes in cross-section a seal retainer flange extending generally horizontally toward the gap, inwardly relative to the bridge-supported flange and vertically spaced above the bridge plate to define with the bridge-supported flange and a portion of the plate an inwardly open cavity, and wherein a portion along the edge of the sealing element is received in the cavity for retention on the frame member.

7. An expansion joint cover according to claim 6 wherein the sealing element includes in cross-section a multiplicity of walls defining of side by side cells, the cells including a pair in the center having transverse upper walls of inverted V-shape, the apices of which lie generally in the plane of the upper surface of the seal retainer flange such that when the gap tends to close the seal retainer flange engages a part of the upper wall of the outer cell nearest to it and causes the upper wall to fold on itself.

8. An expansion joint cover according to claim 7 wherein the cell along one edge of the sealing element has a downwardly concavely curved transverse wall adapted to fold inwardly on itself when the gap tends to close.

9. An expansion joint cover according to claim 6 or claim 8 wherein the bridge plate has an upwardly projecting rib, and the sealing element has a slot receiving the rib in firm engagement such that the sealing element is held down on the bridge plate and is retained in position laterally relative to the bridge plate.

* * * * *